US011220949B2

(12) United States Patent
Teramoto et al.

(10) Patent No.: US 11,220,949 B2
(45) Date of Patent: Jan. 11, 2022

(54) EXHAUST SILENCER DEVICE

(71) Applicants: Taiki Teramoto, Toyota (JP); Takato Ishihata, Takahama (JP); Takehiro Miura, Okazaki (JP); Akira Yamamoto, Okazaki (JP)

(72) Inventors: Taiki Teramoto, Toyota (JP); Takato Ishihata, Takahama (JP); Takehiro Miura, Okazaki (JP); Akira Yamamoto, Okazaki (JP)

(73) Assignees: TOYOTA JIDOSHA KABUSHIKI KAISHA, Toyota (JP); FUTABA INDUSTRIAL CO., LTD., Okazaki (JP)

( * ) Notice: Subject to any disclaimer, the term of this patent is extended or adjusted under 35 U.S.C. 154(b) by 465 days.

(21) Appl. No.: 16/171,886

(22) Filed: Oct. 26, 2018

(65) Prior Publication Data

US 2019/0136740 A1 May 9, 2019

(51) Int. Cl.

| | |
|---|---|
| ***F01N 1/02*** | (2006.01) |
| ***F01N 1/08*** | (2006.01) |
| ***F01N 13/00*** | (2010.01) |
| ***F01N 13/18*** | (2010.01) |

(Continued)

(52) U.S. Cl.

CPC ..... *F01N 13/1805* (2013.01); *F01N 1/003* (2013.01); *F01N 1/083* (2013.01); *F01N 13/02* (2013.01); *F01N 13/1872* (2013.01); *F01N 2470/02* (2013.01); *F01N 2470/04* (2013.01); *F01N 2470/26* (2013.01);

(Continued)

(58) Field of Classification Search

CPC . F01N 1/02; F01N 1/003; F01N 1/006; F01N 1/026; F01N 1/089; F01N 1/083; F01N 1/08; F01N 13/004; F01N 2470/02; F01N 2470/04; F01N 2490/02; F01N 2490/04; F01N 2490/08; F01N 2490/15; F01N 2490/155; F01N 13/1805; F01N 13/1872; F01N 13/02; F01N 2470/26

See application file for complete search history.

(56) References Cited

U.S. PATENT DOCUMENTS 593,970 A * 11/1897 Schwarm ..... F01N 1/08 181/269
1,521,074 A * 12/1924 Carr ..... F01N 13/082 181/227

(Continued)

FOREIGN PATENT DOCUMENTS

CN 101146982 A 3/2008
JP H02-301611 A 12/1990

(Continued)

*Primary Examiner* — Edgardo San Martin
(74) *Attorney, Agent, or Firm* — Oliff PLC

(57) ABSTRACT

An exhaust silencer device which is interposed in an exhaust passage in a vehicle to reduce exhaust noise comprises a sub-muffler which is interposed in the exhaust passage and has an expansion chamber formed therein; an inlet pipe which is airtightly inserted through an inlet opening of the sub-muffler; and an outlet pipe which is airtightly inserted through an outlet opening of the sub-muffler, wherein the inlet pipe and the outlet pipe are formed with openings (small apertures, non-joined portions) only in their upper half area and their lower half area is sealed without having the openings.

7 Claims, 4 Drawing Sheets

(51) Int. Cl.
*F01N 1/00* (2006.01)
*F01N 13/02* (2010.01)

(52) U.S. Cl.
CPC ..... *F01N 2490/08* (2013.01); *F01N 2490/15* (2013.01); *F01N 2570/22* (2013.01)

(56) References Cited

U.S. PATENT DOCUMENTS 1,909,394 A * 5/1933 Dodge ..... F01N 1/06 181/249
2,112,534 A * 3/1938 Johns ..... F01N 13/082 239/418
2,485,392 A * 10/1949 Leadbetter ..... F02M 35/1227 181/255
2,732,026 A * 1/1956 Folts ..... F01N 1/08 181/243
2,940,538 A * 6/1960 Billey ..... F01N 1/003 181/249
3,498,406 A * 3/1970 Heath ..... F01N 1/08 181/265
3,586,123 A * 6/1971 Marlowe ..... F01N 1/003 181/273
3,679,024 A * 7/1972 Kirkland, Jr. ..... F01N 1/089 181/273
3,680,660 A * 8/1972 DuBois ..... F01N 1/003 181/250
3,958,660 A * 5/1976 Boor ..... F01N 1/08 181/269
4,267,899 A * 5/1981 Wagner ..... F01N 1/003 181/272
4,296,832 A * 10/1981 Kicinski ..... F01N 1/02 181/255
4,513,841 A * 4/1985 Shimoji ..... F01N 1/24 181/252
5,020,631 A * 6/1991 DeVille ..... F01N 1/006 181/249
6,158,546 A * 12/2000 Hanson ..... F01N 1/02 181/247
7,743,883 B2 * 6/2010 Kondo ..... H01M 8/04156 181/244
8,833,513 B2 * 9/2014 Matsumoto ..... F01N 1/003 181/228
9,228,475 B2 * 1/2016 Mukai ..... F01N 1/08
2004/0182643 A1 9/2004 Toyoshima
2008/0185218 A1 * 8/2008 Kondo ..... F01N 1/10 181/252
2012/0305330 A1 12/2012 Kainuma

FOREIGN PATENT DOCUMENTS

JP H07-269336 A 10/1995
JP 2000-257418 A 9/2000
JP 2004-251197 A 9/2004
JP 2006-177295 A 7/2006
JP 2006-336496 A 12/2006
JP 2010-127161 A 6/2010
JP 2011-157876 A 8/2011
JP 2013-029046 A 2/2013
JP 2018115576 A * 7/2018
JP 2020125710 A * 8/2020

* cited by examiner

EXHAUST SILENCER DEVICE

CROSS REFERENCE TO RELATED APPLICATION

The disclosure of Japanese Patent Application No. 2017-215881 filed on Nov. 8, 2017 including the specification, claims, drawings, and abstract is incorporated herein by reference in its entirety.

TECHNICAL FIELD

This specification discloses an exhaust silencer device which is interposed in an exhaust passage in a vehicle to reduce exhaust noise.

BACKGROUND

It is generally the case that an exhaust silencer device with a muffler is interposed in an exhaust passage in a vehicle, and exhaust gas flows from the upstream to downstream ends of the muffler. Water contained in the exhaust gas discharged from the engine may be condensed (to generate condensed water) and retained on the bottom of the muffler. When the vehicle stops on a slope with the condensed water accumulated and the muffler is inclined, the condensed water sometimes flows into the exhaust pipe. In such a case, there is a possibility that the exhaust pipe having a small diameter is filled and plugged with the condensed water.

CITATION LIST

Patent Literature

Patent Document 1: JP2000-257418 A

Patent Document 1 discloses an exhaust silencer device which has pipes protruded into a muffler from both of an inlet opening and an outlet opening of the muffler. In this case, even when the muffler inclines and the condensed water flows to enter the inlet opening or the outlet opening of the muffler, the inlet opening and the outlet opening are sealed with the pipes. As a result, the condensed water is suppressed from flowing into the exhaust pipe to some extent.

The technology in Patent Document 1, however, cannot sufficiently suppress the condensed water from flowing out because the positions of apertures formed in the peripheral surfaces of the pipes were not considered fully. In other words, Patent Document 1 provides a plurality of small apertures in the side walls of the pipes, but the positions of the small apertures are not limited. Therefore, when the small apertures are at a low position, the condensed water accumulated in the muffler flows easily into the pipes through the small apertures and eventually the exhaust pipe is easily plugged eventually. In addition, Patent Document 1 does not suggest at all use of a rolled-up pipe which is formed by rolling a flat plate into a pipe, and naturally a rolling overlapped portion of the rolled-up pipe is not taken into consideration in Patent Document 1.

Accordingly, this specification discloses an exhaust silencer device which can prevent plugging of the exhaust pipe more effectively.

SUMMARY

The exhaust silencer device disclosed in this specification is an exhaust silencer device which is interposed in an exhaust passage in a vehicle to reduce exhaust noise, comprising a muffler which is interposed in the exhaust passage and has an expansion chamber formed therein; an inlet pipe which is airtightly inserted through an inlet opening of the muffler to enter the expansion chamber and has one or more openings in its peripheral surface; and an outlet pipe which is airtightly inserted through an outlet opening of the muffler to enter the expansion chamber and has one or more openings in its peripheral surface; wherein the inlet pipe and the outlet pipe are formed with the openings only in their upper half area, and their lower half area is sealed without having the openings.

When configured as described above, the inlet opening and the outlet opening are sealed by the inlet pipe and the outlet pipe, so that the condensed water is prevented from leaking through the inlet opening and the outlet opening. Each pipe is formed with the openings only in its upper half area, and its lower half area is sealed without having the openings. Therefore, the condensed water within a sub-muffler encounters difficulty reaching the apertures, and leakage of water through the openings is also prevented effectively. As a result, the exhaust pipe is effectively prevented from being plugged.

Moreover, at least one of the inlet pipe and the outlet pipe is a rolled-up pipe which is formed by rolling a flat plate into a pipe shape; a rolling overlapped portion of the rolled-up pipe has joined portions, where a winding start portion and a winding end portion of the flat plate are joined, and non-joined portions which are arranged alternately; and the one or more openings may include the non-joined portions.

At least one of the inlet pipe and the outlet pipe is formed of a rolled-up pipe, so that the cost can be reduced. When the rolled-up pipe is used, its rolling overlapped portion has the non-joined portions which become openings, but when the non-joined portions (the openings, the rolling overlapped portion) are positioned in an upper half area of the pipe, fluid leakage through the non-joined portions is effectively prevented and the exhaust pipe is effectively prevented from being plugged.

In addition, at least one of the inlet pipe and the outlet pipe has one or more small apertures in its peripheral surface to communicate with the inside and outside of the pipe; and the one or more openings may include the one or more small apertures.

The inlet pipe is provided with small apertures in its peripheral surface to improve silencing performance. The outlet pipe is provided with small apertures in its peripheral surface to reduce pressure loss. Moreover, when the openings including the small apertures are provided only in the upper half area of the pipes, the fluid leakage through the small apertures can also be effectively prevented and the exhaust pipe is effectively prevented from being plugged.

Both the inlet pipe and the outlet pipe have the one or more small apertures, and the small apertures of the outlet pipe may have a diameter larger than the small apertures of the inlet pipe.

When the small apertures of the outlet pipe are made larger in diameter than the small apertures of the inlet pipe, a pressure loss can be reduced more effectively.

In addition, at least one of the inlet pipe and the outlet pipe may be supported by a separator disposed within the expansion chamber to divide the expansion chamber in a flow direction.

Provision of the separator prevents deflection of the inlet pipe and/or the outlet pipe and can increase a protrusion amount of the inlet pipe and the outlet pipe within the expansion chamber. When the protrusion amount is increased, the condensed water can be more reliably prevented from leaking through the downstream end opening of the inlet pipe or the upstream end opening of the outlet pipe, and consequently the exhaust pipe is more reliably prevented from being clogged.

The outlet pipe is supported by the separator, and the separator may have an approximate funnel shape which continues to the upstream end of the outlet pipe and extends to the upstream side as it extends outward in a radial direction from the upstream end of the outlet pipe.

By configuring as described above, the flow resistance of the exhaust gas flowing to the upsteam end opening of the outlet pipe can be reduced, and the pressure loss can be reduced. Moreover, the separator functions like an extension part of the outlet pipe, so that the outlet pipe length can be shortened, and the cost can be reduced.

In addition, the upstream end of the outlet pipe may be formed to flare out or cut obliquely.

By configuring as described above, a cross-sectional area of the upstream end opening of the outlet pipe increases, and the pressure loss can be reduced.

According to the exhaust silencer device disclosed in this specification, the inlet opening and the outlet opening of the muffler are sealed by the inlet pipe and the outlet pipe, so that the condensed water is prevented from leaking through the inlet opening and the outlet opening. Each pipe is formed with the openings only in the upper half area, and its lower half area is sealed without having the openings. Therefore, the condensed water within the sub-muffler encounters difficulty in reaching the openings, and fluid leakage through the openings is also effectively prevented. As a result, the exhaust pipe is effectively prevented from being clogged.

BRIEF DESCRIPTION OF DRAWINGS

Embodiment(s) of the present disclosure will be described by reference to the following figures, wherein.

DESCRIPTION OF EMBODIMENTS

Figure 1:
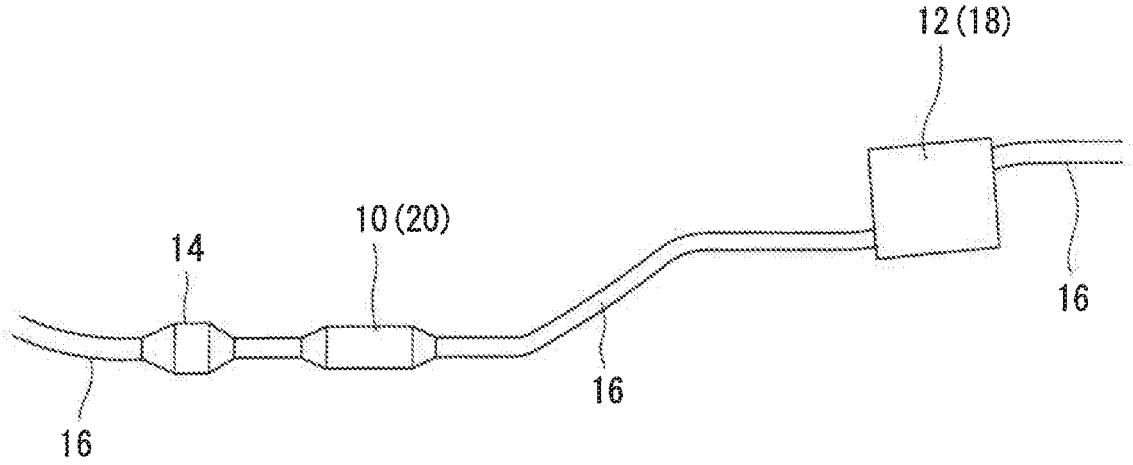
FIG. 1 is a figure showing an exhaust structure having an exhaust silencer device.

An exhaust silencer device will be described below with reference to the drawings. FIG. 1 is a figure showing an exhaust structure having an exhaust silencer device. This exhaust structure has an exhaust pipe 16 which is connected to an engine (not shown) and guides exhaust gas to the outside. A catalytic converter 14, a first exhaust silencer device 10, and a second exhaust silencer device 12 are sequentially interposed in the passage of the exhaust pipe 16 from the upstream side (engine side).

The catalytic converter 14 purifies the exhaust gas and removes harmful components from the exhaust gas by oxidation-reduction reaction, for example. The second exhaust silencer device 12 has a main muffler 18 and suppresses noise by lowering a pressure and a temperature of the exhaust gas by expanding the exhaust gas having flowed into the main muffler 18 and interfering with a pressure wave repeatedly. Details of the structures of the catalytic converter 14 and the second exhaust silencer device 12 are omitted because they can be configured according to known conventional technologies.

Figure 2:
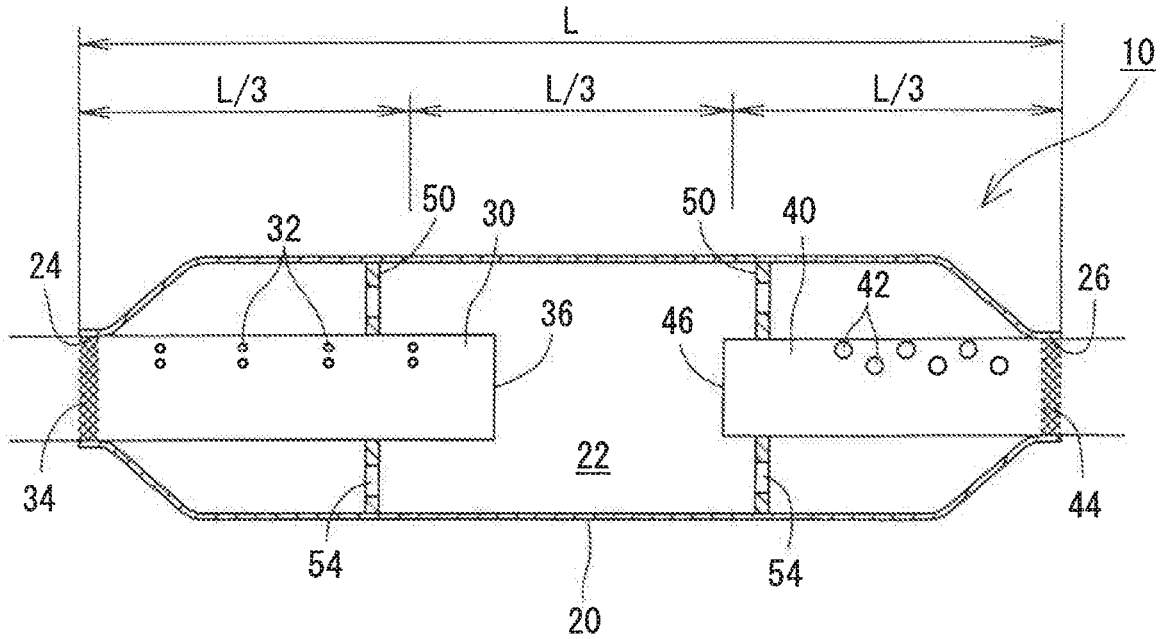
FIG. 2 is a figure showing a structure of a first exhaust silencer device.

FIG. 2 is a figure showing a schematic structure of the first exhaust silencer device 10. In FIG. 2, exhaust gas flows in the horizontal direction on the dawing sheet, and a direction of gravitational force is set in the vertical direction on the dawing sheet. The "direction of a gravitational force" means a gravity direction at a time when a vehicle is stopped on a horizontal plane. The first exhaust silencer device 10 is a device for reducing exhaust noise. The first exhaust silencer device 10 is provided with a sub-muffler 20, an inlet pipe 30 which is extended into the sub-muffler 20 from the upstream side of the sub-muffler 20, and an outlet pipe 40 extended into the sub-muffler 20 from the downstream side of the sub-muffler 20.

The sub-muffler 20 is a substantially cylindrical member having a diameter larger than that of the exhaust pipe 16, and its inside functions as an expansion chamber 22 for rapidly expanding the exhaust gas. Both an upstream end and a downstream end of the sub-muffler 20 have a conical shape which tapers gradually to have a smaller diameter toward its end.

The upstream and downstream ends of the sub-muffler 20 are respectively formed with an inlet opening 24 and an outlet opening 26. The inlet opening 24 has the later-described inlet pipe 30 which is inserted through it. The outer peripheral surface of the inlet pipe 30 is airtightly adhered to the inner peripheral surface of the inlet opening 24. In other words, the outer peripheral surface of the inlet pipe 30 and the inner peripheral surface of the inlet opening 24 have a seal portion 34 between them. Therefore, the exhaust gas cannot enter the expansion chamber 22 without passing through the inlet pipe 30. As described later, the condensed water accumulated in the sub-muffler 20 also cannot pass through the seal portion 34.

The outlet opening 26 has the later-described outlet pipe 40 inserted through it. The outer peripheral surface of the outlet pipe 40 is airtightly adhered to the inner peripheral surface of the outlet opening 26. Therefore, the outer peripheral surface of the outlet pipe 40 and the inner peripheral surface of the outlet opening 26 also have a seal portion 44 between them. Accordingly, neither the exhaust gas nor the condensed water can pass through the seal portion 44.

The inlet pipe 30 is a pipe having a diameter sufficiently smaller than the sub-muffler 20. The inlet pipe 30 is connected to the exhaust pipe 16 and extends into the sub-muffler 20 (into the expansion chamber 22) from the upstream side of the sub-muffler 20. In this example, the inlet pipe 30 is formed of a rolled-up pipe which is made by cylindrically rolling one flat plate as described later. The rolled-up pipe can be made inexpensively as compared with seamless pipes, and apertures can be easily formed in the peripheral surface by previously forming in the flat plate before rolling.

A downstream end opening 36 is formed at the downstream end of the inlet pipe 30. The exhaust gas flowing through the inlet pipe 30 is ejected partially into the expansion chamber 22 from the downstream end opening 36 of the inlet pipe 30. In the process of ejection, the exhaust gas expands suddenly to reduce the exhaust noise. The distance from the inlet opening 24 to the downstream end opening 36; namely, the protrusion amount of the inlet pipe 30 in the expansion chamber 22, is one-third or more of an overall length L of the sub-muffler 20. However, the protrusion amount of the inlet pipe 30 may be changed suitably in accordance with a required silencing performance, a later-described liquid leakage preventing function, etc.

The inlet pipe 30 has a plurality of small apertures 32 formed in its peripheral surface. The exhaust gas flowing through the inlet pipe 30 is partially expanded rapidly while it is being ejection from the small apertures 32. Thus, the exhaust noise is reduced. The number, size, and shape of the small apertures 32 may be set properly in accordance with noise performance.

The outlet pipe 40 is also a pipe connected to the exhaust pipe 16 and extends into the sub-muffler 20 (the expansion chamber 22) from the downstream side of the sub-muffler 20. And, the outlet pipe 40 is formed of a rolled-up pipe which is made by cylindrically rolling one flat plate in the same manner as the inlet pipe 30.

The outlet pipe 40 is formed with an upstream end opening 46 at its upstream end. The exhaust gas in the sub-muffler 20 flows into the outlet pipe 40 through the upstream end opening 46 and is discharged out of the sub-muffler 20. The distance from the outlet opening 26 to the upstream end opening 46; namely, the protrusion amount of the outlet pipe 40 in the expansion chamber 22, is one-third or more of the overall length L of the sub-muffler 20. However, the protrusion amount of the outlet pipe 40 may be changed suitably in accordance with a required silencing performance, a later-described liquid leakage preventing function, etc.

The outlet pipe 40 also has a plurality of small apertures 42 formed in its peripheral surface. The small apertures 42 are apertures allowing the exhaust gas to flow into and out of the outlet pipe 40. The small apertures 42 are provided to reduce a pressure difference between the outlet pipe 40 and the expansion chamber 22 and to reduce a pressure loss. Namely, the small apertures 32 are formed in the inlet pipe 30 mainly for silencing, but the small apertures 42 are formed in the outlet pipe 40 mainly for pressure loss reduction. Therefore, the small apertures 42 of the outlet pipe 40 have a diameter larger than those of the small apertures 32 of the inlet pipe 30.

Figure 3:
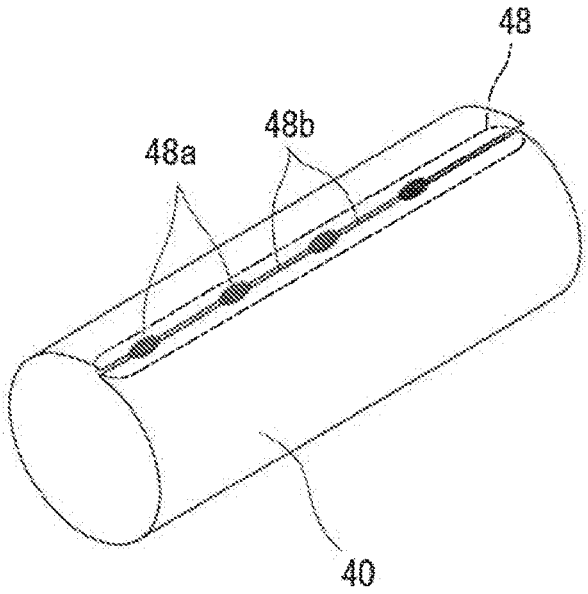
FIG. 3 is a schematic perspective view of an outlet pipe.

Both the inlet pipe 30 and the outlet pipe 40 are formed of a rolled-up pipe as described above, and their peripheral surfaces have non-joined portions which are a type of opening. The non-joined portions are explained with reference to FIG. 3. FIG. 3 is a schematic perspective view of the outlet pipe 40. The small apertures 42 are not shown in FIG. 3.

The rolled-up pipe configuring the outlet pipe 40 is formed by rolling a flat plate cylindrically to have the respective ends in a width direction of the plate overlap or approach each other and mutually joining the rolling start part and the rolling end part at a rolling overlapped portion 48. In this example, welded portions 48*a* at the rolling overlapped portion 48 are not arranged continuously but at intervals in the axial direction. In other words, non-joined portions 48*b* where the rolling start part and the rolling end part are not welded are arranged at intervals along the rolling overlapped portion 48. The non-joined portions 48*b* are one type of opening which communicates between the inside and the outside of the pipe. The inlet pipe 30 also has non-joined portions (not shown) which are one type of opening.

Figure 4:
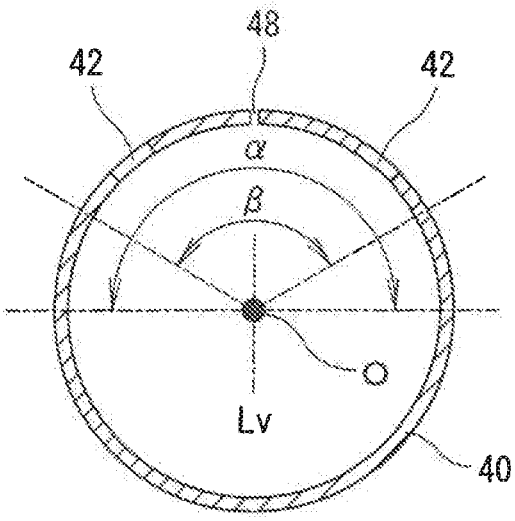
FIG. 4 is a schematic sectional view of the outlet pipe.

In other words, the peripheral surfaces of the inlet pipe 30 and the outlet pipe 40 have the small apertures 32, 42 and the non-joined portions 48*b* as openings which communicate between the inside and the outside of the pipes. In this example, the openings (small apertures 32, 42, and non-joined portions 48*b*) are desirably formed in an area which is located only at a relatively high position of the peripheral surfaces of the pipes 30, 40. This situation will be described with reference to FIG. 4 which is a schematic sectional view of the outlet pipe 40.

The openings such as the small apertures 42 and the non-joined portions 48*b* (the rolling overlapped portion 48) are desirably formed only in an upper half area of the outlet pipe 40; namely, in a range $\alpha$ which covers ±90 degrees on both sides of a vertical line Lv passing through a center ○. It is more desirable that the small apertures 42 and the non-joined portions 48*b* are formed only in a range $\beta$ which covers ±60 degrees on both sides of the vertical line Lv. In other words, it is desirable that the lower half area of the outlet pipe 40 does not have openings (the small apertures 42 and the non-joined portions 48*b*) but is closed completely. It is also desirable that the inlet pipe 30 is formed with openings (the small apertures 32 and the non-joined portions) in a range which covers ±90 degrees on both sides of the vertical line passing through the center and more desirably in a range which covers ±60 degrees. Such a structure is provided so that the condensed water encounters difficulty in reaching the openings. This point will be described later in detail.

Figure 5:
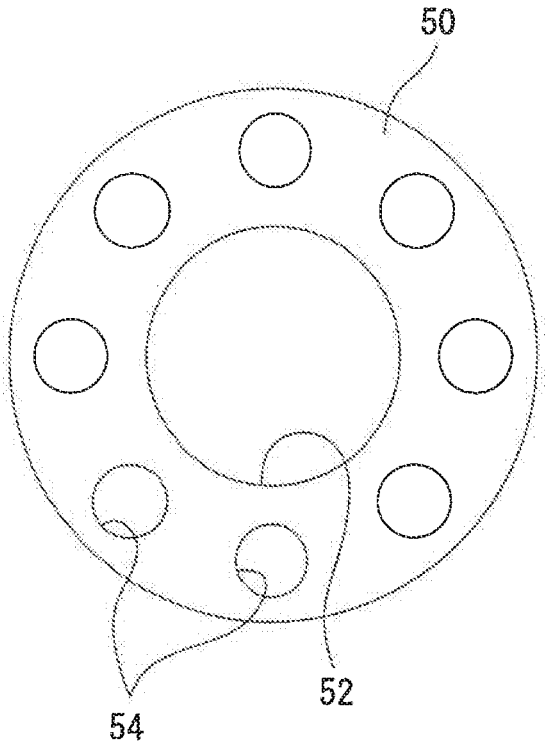
FIG. 5 is a front view of a separator.

The inlet pipe 30 and the outlet pipe 40 are respectively supported by a separator 50 within the sub-muffler 20. FIG. 5 is a front view of the separator 50. The separator 50 is a partition disposed within the expansion chamber 22 to divide the expansion chamber 22 in the flowing direction. A through hole 52 through which the inlet pipe 30 or the outlet pipe 40 is inserted is formed almost at the center of the separator 50. The inlet pipe 30 or the outlet pipe 40 is inserted through the through hole 52 and supported by the separator 50. The separator 50 is formed with a plurality (eight in the shown example) of communication holes 54 around the through hole 52. The communication holes 54 are holes to allow the exhaust gas to flow within the expansion chamber 22, and no particular limitations are imposed on their number, size, and shape. At any rate, by disposing the separator 50 for supporting the pipes 30, 40, the protrusion amount of the pipes 30, 40 within the expansion chamber 22 can be increased while the deflection of the pipes 30, 40 is prevented.

As described above, the first exhaust silencer device 10 disclosed in this specification has the pipes 30, 40 airtightly inserted through both the inlet opening 24 and the outlet opening 26 of the sub-muffler 20, and the openings (the small apertures 32, 42 and the non-joined portions 48*b*) of the individual pipes 30, 40 are formed only in the upper half area of the peripheral surfaces of the pipes 30, 40. A reason for having the above configuration will be described in comparison with the prior art.

Figure 9:
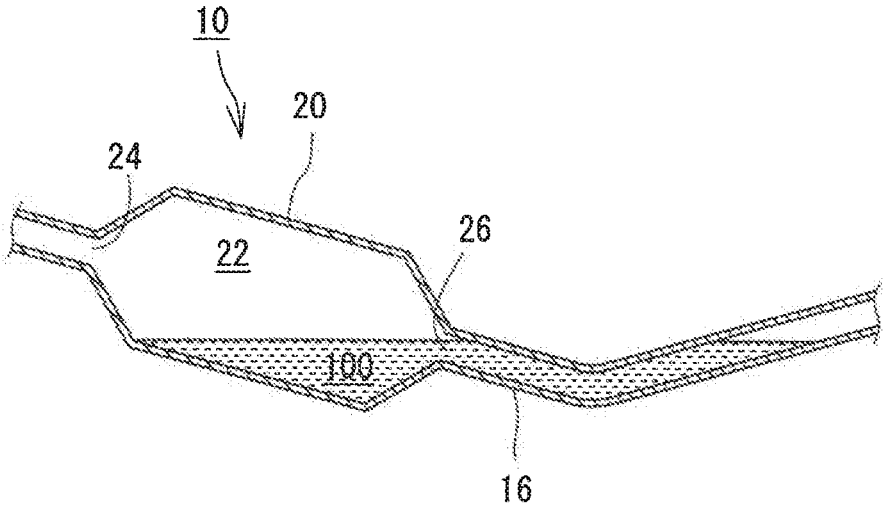
FIG. 9 is a figure showing an example of a conventional first exhaust silencer device.

High-temperature exhaust gas is discharged from the engine, and the exhaust gas is gradually cooled down while passing through the exhaust passage. While the temperature is being lowered, water contained in the exhaust gas is condensed to become condensed water. The condensed water is sometimes accumulated on the bottom part of the sub-muffler 20. When a large amount of the condensed water is accumulated on the bottom part of the sub-muffler 20, the exhaust pipe 16 is sometimes plugged. For example, it is assumed that a vehicle with the condensed water accumulated in a large amount on the bottom part of the sub-muffler 20 is stopped in a backward inclined posture. In this case, as shown in FIG. 9, condensed water 100 within the sub-muffler 20 flows into the downstream exhaust pipe 16 from the outlet opening 26, and the exhaust pipe 16 is partially filled with the condensed water 100. In addition, if the condensed water 100 freezes in this state, there are problems that the exhaust pipe 16 is damaged by freezing and expansion and plugged completely so that it becomes difficult to restart the engine. Contrary to FIG. 9, when a vehicle is stopped in a forward inclined posture, the condensed water 100 flows into the upstream side exhaust pipe 16 through the inlet opening 24, and the exhaust pipe 16 is partially filled with the condensed water 100.

Figure 6:
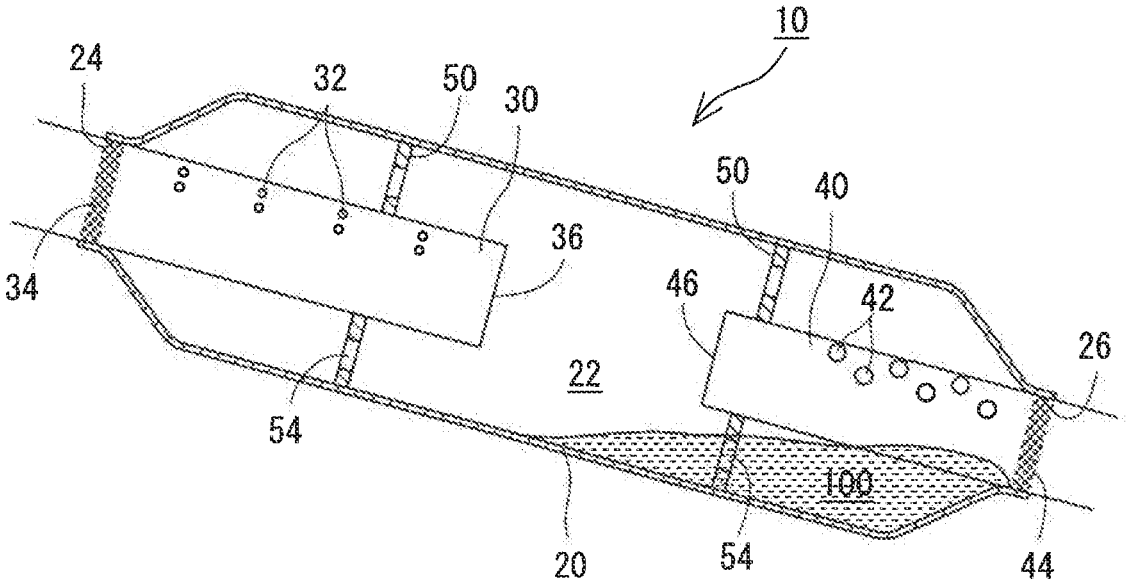
FIG. 6 is a figure showing an inclined state of the first exhaust silencer device.

To prevent the exhaust pipe 16 from being plugged, it is desired to prevent leakage of the condensed water accumulated in the sub-muffler 20. Therefore, in the first exhaust silencer device 10 disclosed in this specification, the inlet opening 24 and the outlet opening 26 are sealed by the inlet pipe 30 and the outlet pipe 40. FIG. 6 is a view showing a state where the first exhaust silencer device 10 disclosed in this specification is brought into a backward inclined posture. In this case, the condensed water 100 accumulated in the sub-muffler 20 flows toward the outlet opening 26. In this case, however, the condensed water 100 cannot get out of the sub-muffler 20 because it is blocked by the seal portion 44 which is between the outlet opening 26 and the outlet pipe 40. As a result, leakage of the condensed water 100 to the exhaust pipe 16 and plugging of the exhaust pipe 16 are effectively prevented.

Incidentally, as shown in FIG. 6, when the first exhaust silencer device 10 is inclined, the condensed water 100 contacts partially with a lower part of the peripheral surface of the outlet pipe 40. At this time, when the openings such as the small apertures 42 or the non-joined portions 48*b* are formed in a lower part of the peripheral surface of the outlet pipe 40, the condensed water 100 flows into the outlet pipe 40 through the openings and leaks out of the sub-muffler 20. Then, this case has the openings formed only in the relatively high area (in the upper half area) of the peripheral surface of the outlet pipe 40 as described above. Consequently, the condensed water 100 encounters difficulty in reaching the openings, and leakage of the condensed water 100 and clogging of the exhaust pipe 16 are prevented effectively.

Even when the openings are formed in a high area, the condensed water 100 might leak through the upstream end opening 46 of the outlet pipe 40 if the protrusion amount of the outlet pipe 40 in the expansion chamber 22 is small. Therefore, the protrusion amount of the outlet pipe 40 is desirably increased to a level such that the leakage can be prevented. The protrusion amount of the outlet pipe 40 may be set in accordance with an estimated storage amount of the condensed water 100, an estimated inclination angle of the vehicle, etc. and it is desirably one-third or more of the overall length L of the sub-muffler 20, for example.

The same effect can also be provided by the inlet pipe 30. That is, the seal portion 34 is also disposed between the inlet pipe 30 and the inlet opening 24, so that the condensed water 100 does not pass through the inlet opening 24 even if the vehicle is brought into a forward inclined posture, and plugging of the exhaust pipe 16 is prevented effectively. In addition, the inlet pipe 30 has its openings only in an area at a level higher than a reference line, and the condensed water 100 encounters difficulty in reaching the openings. As a result, plugging of the exhaust pipe 16 is prevented effectively. In addition, when the protrusion amount of the inlet pipe 30 is set to one-third or more of the overall length L of the sub-muffler 20, it becomes easy to prevent leakage of the condensed water 100 through the downstream end opening 36.

Figure 7A:
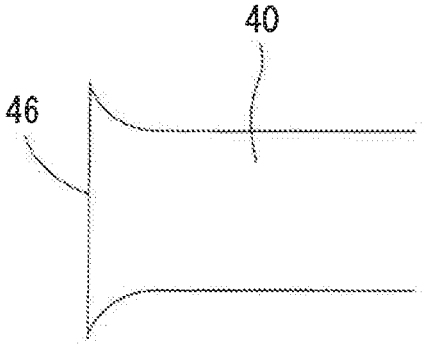
FIG. 7A is a figure showing a form of an upstream end of the outlet pipe.
Figure 7B:
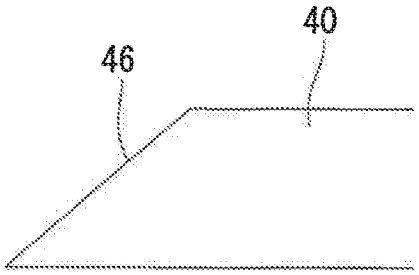
FIG. 7B is a figure showing another form of the upstream end of the outlet pip.

When the inlet opening 24 and also the outlet opening 26 are closed by the pipe (the outlet pipe 40) as in this case, an exhaust resistance of the exhaust gas increases, the back pressure in the sub-muffler 20 increases, and a pressure loss tends to increase as a result. Therefore, to suppress an increase in the pressure loss, it is desirable that the upstream end opening 46 of the outlet pipe 40 has as large a large cross-sectional area as possible. Consequently, for example, the upstream end of the outlet pipe 40 may be formed to have a shape which is formed to flare out as it approaches the upstream end as shown in FIG. 7A. By configuring in this way, the cross-sectional area of the upstream end opening 46 can be increased and the pressure loss can be reduced. As another embodiment, the upstream end of the outlet pipe 40 may be obliquely cut as shown in FIG. 7B. By configuring in this way, a cross sectional area of the upstream end opening 46 can be increased and the pressure loss can be reduced.

Figure 8:
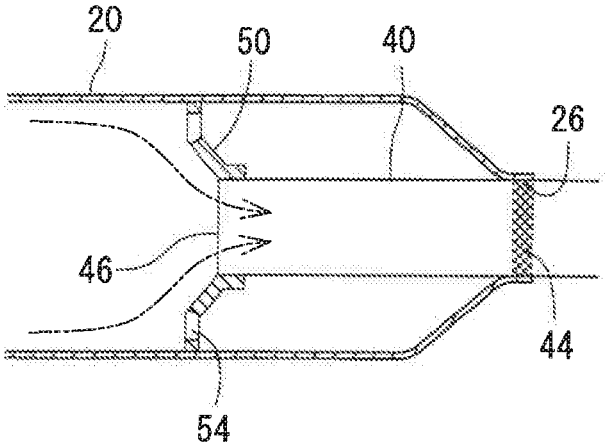
FIG. 8 is a figure showing another form of the separator which supports the outlet pipe.

As shown in FIG. 8, a separator 50 may be formed to have a funnel shape which continues to the upstream end opening 46 of the outlet pipe 40. Namely, the separator 50 is formed to have a shape which extends to the upstream side as it extends outward in a radial direction from the through hole 52. Moreover, the upstream end of the outlet pipe 40 is positioned in the through hole 52 of the separator 50. By configuring in this way, the exhaust gas which hits the separator 50 is smoothly introduced along the separator 50 into the upstream end opening 46 of the outlet pipe 40. As a result, a flow resistance of the exhaust gas decreases, and a pressure loss can be reduced.

To prevent leakage of the condensed water, the protrusion amount of the outlet pipe 40 is desired to be larger, but the cost of the outlet pipe 40 increases accordingly. As shown in FIG. 8, when the separator 50 is continued to the upstream end of the outlet pipe 40, the separator 50 can be used as an extension of the upstream end of the outlet pipe 40. In other words, when the separator 50 is continued to the upstream end of the outlet pipe 40, the outlet pipe 40 can be shortened and the cost can be reduced, because the same effect as when the outlet pipe 40 is long (extended) can be obtained even when the outlet pipe 40 is shortened.

The above-described configuration is one example, and if the openings are formed only in the upper half area of the inlet pipe 30 and the outlet pipe 40 and the lower half area is closed, other configurations may be changed appropriately. For example, in the above description the small apertures 32, 42 and the non-joined portions 48*b* were explained as the openings, but the openings may be only either of the small apertures 32, 42 and the non-joined portions 48*b*, and different types of openings may also be formed. Therefore, for example, the outlet pipe 40 may have a shape with only the non-joined portions 48*b* as the openings without having the small apertures 42. In addition, it may be the case that the non-joined portions 48*b* as the openings are formed only in the upper half area of the outlet pipe 40. The separator 50 is provided in the above description, but may be omitted if the deflection of the individual pipes 30, 40 can be prevented.

The first exhaust silencer device 10 was described above as an example, but the structure disclosed in this specification may be applied to another exhaust silencer device, such as the second exhaust silencer device 12 (main muffler).

REFERENCE SIGNS LIST

10 First exhaust silencer device; 12 Second exhaust silencer device; 14 Catalytic converter; 16 Exhaust pipe; 18 Main muffler, 20 Sub-muffler, 22 Expansion chamber; 24 Inlet opening; 26 Outlet opening; 30 Inlet pipe; 32, 42 Small apertures; 34, 44 Seal portion; 36 Downstream end opening; 40 Outlet pipe; 46 Upstream end opening; 48 Rolling overlapped portion; 48*a* Welded portions; 48*b* Non-joined portions; 50 Separator, 52 Through hole; 54 Communication holes; 100 Condensed water

The invention claimed is:

1. An exhaust silencer device which is interposed in an exhaust passage in a vehicle to reduce exhaust noise, the exhaust silencer device comprising:

a muffler which is interposed in the exhaust passage and has an expansion chamber formed therein;

an inlet pipe which is airtightly inserted through an inlet opening of the muffler and extends into the expansion chamber, a peripheral surface of the inlet pipe having one or more apertures; and an outlet pipe which is airtightly inserted through an outlet opening of the muffler and extends into the expansion chamber, a peripheral surface of the outlet pipe having one or more apertures, wherein the apertures of the inlet pipe and of the outlet pipe are disposed only in upper half areas of the inlet and outlet pipes, and lower half areas of the inlet and outlet pipes are solid and have no apertures therein.

2. The exhaust silencer device according to claim 1, wherein:

at least one of the inlet pipe and the outlet pipe is a rolled-up pipe which is formed by rolling a flat plate into a pipe shape;

a rolling overlapped portion of the rolled-up pipe has joined portions, where a winding start portion and a winding end portion of the flat plate are joined to each other, arranged alternately with non-joined portions; and the non-joined portions form at least some of the one or more apertures.

3. The exhaust silencer device according to claim 1, wherein:

each of the inlet pipe and the outlet pipe has a plurality of the apertures.

4. The exhaust silencer device according to claim 3, wherein:

the apertures of the outlet pipe have a diameter larger than a diameter of the apertures of the inlet pipe.

5. The exhaust silencer device according to claim 1, wherein at least one of the inlet pipe and the outlet pipe is supported by a separator disposed in the expansion chamber to divide the expansion chamber in a flow direction.

6. The exhaust silencer device according to claim 5, wherein:

the outlet pipe is supported by the separator; and the separator has an approximate funnel shape which continues to an upstream end of the outlet pipe and extends to an upstream side as the separator extends outward in a radial direction from the upstream end of the outlet pipe.

7. The exhaust silencer device according to claim 1, wherein an upstream end of the outlet pipe is formed to flare out or is cut obliquely.

* * * * *